US010751731B2

(12) United States Patent
Dobos et al.

(10) Patent No.: US 10,751,731 B2
(45) Date of Patent: Aug. 25, 2020

(54) ROTATIONAL UNIT FOR A ROTOR OF A DUAL CENTRIFUGE

(71) Applicant: ANDREAS HETTICH GMBH & CO. KG, Tuttlingen (DE)

(72) Inventors: Jovan Dobos, Tuttlingen (DE); Klaus-Guenter Eberle, Tuttlingen (DE); Ulrich Massing, Merzhausen (DE); Anke Lenz, Leibertingen (DE)

(73) Assignee: ADREAS HETTICH GMBH & CO. KG, Tuttlingen (DE)

( * ) Notice: Subject to any disclaimer, the term of this patent is extended or adjusted under 35 U.S.C. 154(b) by 499 days.

(21) Appl. No.: 15/541,358

(22) PCT Filed: Nov. 24, 2015

(86) PCT No.: PCT/EP2015/077536
§ 371 (c)(1),
(2) Date: Jun. 30, 2017

(87) PCT Pub. No.: WO2016/107705
PCT Pub. Date: Jul. 7, 2016

(65) Prior Publication Data

US 2017/0348704 A1 Dec. 7, 2017

(30) Foreign Application Priority Data

Jan. 2, 2015 (DE) ..... 10 2015 100 004

(51) Int. Cl.
*B04B 5/02* (2006.01)
*B04B 5/04* (2006.01)

(52) U.S. Cl.
CPC ..... *B04B 5/02* (2013.01); *B04B 5/0414* (2013.01)

(58) Field of Classification Search
CPC ..... B04B 5/02; B04B 5/0414
(Continued)

(56) References Cited

U.S. PATENT DOCUMENTS 4,493,691 A 1/1985 Calari
4,531,932 A 6/1985 Luppi et al.
(Continued)

FOREIGN PATENT DOCUMENTS

CN 1220331 A 6/1999
CN 1415423 A 5/2003
(Continued)

OTHER PUBLICATIONS

The State Intellectual Property Office of China, Notification of the First Office Action, Office Action, dated Jul. 3, 2019, pp. 1-6.
(Continued)

*Primary Examiner* — Walter D. Griffin
*Assistant Examiner* — Shuyi S. Liu
(74) *Attorney, Agent, or Firm* — Woodling, Krost and Rust

(57) ABSTRACT

The invention relates to a rotational unit (10) for a rotor of a dual centrifuge, said rotational unit having a bearing (14) and a rotational head (24) which is connected to the bearing (14), is mounted therein such that it can rotate about an axis of rotation and can be driven relative to the rotor by an additional rotational mechanism of the centrifuge, the rotational head (24) being detachably connected to the receiving unit (40, 80) for conjoint rotation, which receiving unit comprises a sample container receptacle (60, 70, 100, 110) for at least one sample container. The invention is characterized in that the receiving unit (40, 80) and the rotational head (24) are connected by a frictional connection in which some portions of the receiving unit (40, 80) and the rotational head (24) engage in each other in a wedge-like manner, and the frictional connection increases with a movement of the receiving unit (40, 80) along the axis of rotation of the rotational unit (10) in the direction toward the rotational head (24).

20 Claims, 7 Drawing Sheets

(58) Field of Classification Search
USPC ..... 494/16, 19
See application file for complete search history.

(56) References Cited

U.S. PATENT DOCUMENTS

| | | | | |
|---|---|---|---|---|
| 7,806,819 | B2 | 10/2010 | Eigemeier | |
| 2016/0310966 | A1* | 10/2016 | Henne | B04B 5/0421 |

FOREIGN PATENT DOCUMENTS

| | | | |
|---|---|---|---|
| CN | 1820854 | A | 8/2006 |
| CN | 202893518 | U | 4/2013 |
| EP | 0402668 | | 5/1990 |
| JP | S58180951 | A | 10/1983 |
| JP | 2001276592 | A | 10/2001 |
| JP | 2009119587 | | 6/2009 |
| JP | 2010194470 | | 9/2010 |
| WO | 2014006059 | | 1/2014 |

OTHER PUBLICATIONS

The State Intellectual Property Office of China, English Translation of the Notification of the First Office Action, Office Action, dated Jul. 3, 2019 pp. 1-5.
Japan Patent Office, Notification of Reason for Refusal, Office Action, dated Jun. 18, 2019, pp. 1-3.
Japan Patent Office, English Translation of the Notification of Reason for Refusal, Office Action, dated Jun. 18, 2019, pp. 1-2.
European Patent Office, International Search Report, dated Apr. 14, 2016, pp. 1-12, International Application No. PCT/EP2015/077536, Applicant: Andreas Hettich GMBH & Co. KG.

* cited by examiner

ROTATIONAL UNIT FOR A ROTOR OF A DUAL CENTRIFUGE

This patent application is the national phase entry of PCT/EP2015/077536, international application filing date Nov. 24, 2015, which claims the benefit and priority of and to German patent application no. 10 2015 100 004.0, filed Jan. 2, 2015.

PCT/EP2015/077536, international application filing date Nov. 24, 2015 and German patent application no. 10 2015 100 004.0, filed Jan. 2, 2015 are incorporated herein by reference hereto in their entireties.

The invention relates to a rotational unit for a rotor of a dual centrifuge.

Rotational units for a rotor of a dual centrifuge are known in the prior art, one or plural of which can be disposed in the rotor and used to accommodate centrifuge tubes containing sample material in a sample container receptacle of a receiving unit, for example. Frequently, however, secure mounting of the sample container during centrifugation can only be guaranteed if the receiving unit engages a rotational head of the rotational unit to a major extent to prevent it from being ejected from the rotational head as a result of the forces generated during rotation. Firstly, this is disadvantageous as regards overall size. Secondly, it is not easy or downright impossible to securely mount the rotational unit in a rotational unit since certain assignments require the sample tubes to be inserted horizontally into the rotational head.

Furthermore, the limited installation space, in particular in the case of tabletop centrifuges, generally makes it difficult to provide additional safety measures, for example to ensure that the receiving unit is non-rotatably mounted in the rotational head or to contain contamination by sample material in the case of damage to a receptacle during centrifugation.

JP 2009-119 587 A discloses a dual centrifuge which includes a rotational head and a receiving unit. The receiving unit and the rotational head are positively connected to each other which results in small relative movements owing to the tolerances and thus in additional imbalances during operation. These imbalances in turn result in heavy wear in operation and thus in premature failure of the centrifuge.

It is the object of the invention to create a rotational unit which avoids the above-mentioned shortcomings and to further develop this rotational unit such that sample material held in a receptacle, for example a tube, can be placed more securely in the rotational unit by means of a receiving unit where it takes up only little space, and furthermore to propose various enhanced sample container receptacles as well as corresponding receiving units that are capable of accommodating various sizes and different numbers of receiving sample containers.

The invention is based on the finding that a frictional connection/clamped connection between the receiving unit and the rotational head will allow the receiving unit to be securely mounted and easily replaced. Moreover, less installation space will be required as a result.

According to the invention the rotational unit for a rotor of a centrifuge has bearing and a rotational head which is connected to the bearing and is mounted therein such that it can rotate about an axis of rotation, and which can be driven relative to the rotor by an additional rotational mechanism of the centrifuge. The rotational head is detachably connected to a receiving unit for conjoint rotation, which receiving unit is capable of accommodating at least one sample container receptacle to be inserted therein, and which contains the sample. The receiving unit and the rotational head are connected by a frictional connection in which some portions of the receiving unit and the rotational head engage in a wedge-like manner, and the frictional connection increases as the receiving unit moves along the axis of rotation of the rotational unit in the direction toward the rotational head. The required conditions for wedge-like frictional connections can be easily implemented technically. A user can thus readily produce and also release the frictional connection/clamp connection between the rotational head and the receiving unit without any tools.

In a preferred embodiment of the invention, the rotational unit is obliquely mounted and arranged in the rotor in such a way that increasing rotation will urge the receiving unit into the frictional connection. The forces generated during rotation are thus used to enhance the wedging of the receiving unit with the rotational unit. This is a simple and secure way of mounting of the receiving unit in the rotational unit regardless of the speed of rotation.

In one aspect of the invention, the frictional connection is effected between an underside of the receiving unit and a front side of the rotational head. In this way, the wedge-like frictional connection can be produced especially easily since the wedging/clamping is essentially produced by the insertion of the receiving unit, and the wedge-like frictional connection is released by removing the receiving unit.

It is advantageous if stops are provided for limiting the movement into the wedge-like frictional connection. These stops will therefore limit the travel of the receiving unit into the rotational head to a defined maximum. This increases the operation safety of the centrifuge since it prevents excessive wedging/clamping and any irreversible jamming possibly resulting therefrom. Moreover, such stops also reduce the likelihood of receiving units being accidentally inserted which are not suitable for use with the rotational head.

In particular, the frictional connection of the receiving unit and the rotational head comprises frusto-conical feet which engage in matching recesses, with either the receiving unit being provided with the feet and the rotational head with the recesses, or vice versa. It is also possible to provide both feet and recesses on the receiving unit and on the rotational head. The conical shape of the feet ensures a good wedging/clamping effect and high shearing strength, and the outer contour of the feet which tapers in the direction of the recesses at the same time serves to center the feet in the recesses in a simple way.

In yet another advantageous embodiment of the invention, the longitudinal axes of the feet are aligned in parallel to the axis of rotation of the rotational head, and the feet are of a rotationally symmetrical design, with a longitudinal section through the resulting line of the surface of the cone extending at an angle of 10° to 35°, in particular 15°, relative to the axis of rotation. This angle range yields a particularly favorable ratio of the shearing strength of the feet on the one hand and the wedging/clamping effect on the other hand. Moreover, the feet will be optimally centered in the recesses as the receiving unit is inserted in the rotational head.

In order to facilitate production and increase the stability under load of the frictional connection, the feet and the receiving unit are integrally formed and made of the same material, and/or the feet and the rotational head are integrally formed and made of the same material.

In another aspect of the invention, the number and dimensions of the feet are adapted to the shearing strength of the material of the feet against the forces resulting from the alternating rotational stress during operation of the dual centrifuge. As a result, the wedge-like frictional connection will not be unintentionally released and damage the centrifuge interior during operation owing to an insufficient number and/or size of the feet. At the same time, material costs and constructional effort can also be reduced since only the minimum number and size of the feet required for safe operation is provided.

It has proved advantageous for the ratio of the diameter of the base area of one frusto-conical foot relative to the height of the frustum to be 10:6. Experience has shown that this will result in an optimum ratio between the shearing strength of the feet and the stability of the frictional connection.

Preferably, the material used for the receiving unit is plastic, in particular polyamide, the material used for the rotational head and the sample container receptacles is aluminum, in particular the aluminum alloy EN AW-Al Zn5Mg3Cu-T6. This will yield a particularly good ratio of strength, workability and costs of these materials.

The rotor is driven by a drive shaft. Depending on the requirements regarding strength, stability, weight etc. the drive shaft can be made of aluminum or steel, or covered with steel.

A particular simple way of achieving a secure and stable frictional connection is to provide an even number of feet, i.e. at least four, which are arranged rotationally symmetrically relative to each other and uniformly spaced from each other. In addition, this rotationally symmetrical arrangement prevents the occurrence of imbalances.

The receiving unit preferably has a symmetrical design, therefore providing two positions for inserting the receiving unit into the rotational unit instead of merely one.

If the feet are provided at the edge of the receiving unit, the shearing forces acting on the feet will be lower. This results in a reduced load on the material and thus safer operation of the rotational head.

However, the receiving unit can be mounted in an even safer way by providing the rotational head with a safety vessel that is open towards the top. In a mounted state, this safety vessel will completely surround the receiving unit laterally, in particular with the sample container(s) inserted into the sample container receptacle(s). This will also prevent the receiving unit from breaking loose in a lateral direction relative to the axis of rotation in case the wedging/clamping action of feet and recesses is lost, for example due to material defects. Furthermore, this will prevent leakage of sample material from the safety vessel, e.g. after destruction of a sample container, if it is of a completely closed design.

It is considered advantageous for the bottom of the rotational head or the bottom of the safety vessel to have a circumferential safety channel for collecting sample material that has leaked out. Leaked-out sample material will be caught in it and can distribute in it. This prevents leaked-out sample material from collecting in a single spot and thus causing an imbalance.

If the safety vessel has a lid, in particular of the completely closed type, which lid can preferably be connected to the safety vessel by means of a quick-release fastener or a screw connection, the rotational head and in particular the bearing connected to the rotational head as well as the rest of the interior space of the dual centrifuge will be protected from contamination in case of damage to a receiving unit and the sample containers accommodated therein, since this will prevent spillage of sample material. Moreover, the lid may afford further protection against the receiving unit breaking loose.

In an alternative embodiment, the bottom of the safety vessel is provided with the feet and/or the recesses for connecting it to the receiving unit. As a result, the receiving unit will be mounted more securely within the safety vessel. Furthermore, this will enhance the protective effect of the safety vessel regarding potential contamination of the environment since the safety vessel can be sealed more easily.

Preferably, the safety vessel is connected to the rotational head via fastening means, in particular it is riveted thereto. This will ensure that the safety vessel does not become unfastened from the rotational head during operation and damage the centrifuge.

To further enhance the operational safety of the rotational unit, the rotational head and the safety vessel are integrally formed as a single-piece unit and made of the same material. The reduction in the number of its components makes the system more stable.

Preferably the safety vessel is completely closed, and it is advantageous if the lid is completely closed as well.

In an alternative embodiment of the invention, the wedge-like frictional connection acts on a lateral surface of the receiving unit and a circumferential wall of the safety vessel. This embodiment is safe as well and not very prone to defects.

Preferably the sample container receptacle can be inserted into the receiving unit and is detachably mounted therein. The receiving unit and the sample container receptacle are thus of a two-part design. This allows different sample container receptacles to be introduced into a receiving unit.

Furthermore, it is considered very advantageous to provide a set of receiving units for different sample container receptacles for sample containers and/or for different loads, with the respective receiving unit then being selectively introduced into the rotational head. This ensures that a wide range of sample containers, in varying numbers, can be processed and that suitable sample container receptacles for sample containers are always available which are safely supported in the rotational head by a strong wedging/clamping effect.

In particular, the receiving unit has a receiving space with two legs for two different sample container receptacles. Consequently, the number of different receiving units required can be reduced by half.

Preferably, a clamping device is used to mount the sample container receptacle in the receiving space of the receiving unit without any clearance. This prevents the sample container from becoming detached from the receiving unit, which increases the safety of the centrifuge during centrifugation and minimizes the danger of damage or contamination in the case of a defect.

To fix the sample container in place in a simple yet effective manner, the receiving unit has a first stop against which the sample container abuts, and a second stop is provided on the end which is remote from the first stop. The sample container is thus firmly clamped between the first and second stops.

It has proven advantageous for the receiving unit and the sample container receptacle to be integrally formed. This reduces the number of components required which makes the mounting of the sample container even safer.

Additional advantages, features and possible application of the present invention may be gathered from the description which follows, in which reference is made to the embodiments illustrated in the drawings.

Throughout the description, the claims and the drawings, those terms and associated reference signs are used as are listed in List of Reference Signs which follows below. In the drawings, FIG. 1 is an exploded view of a rotational unit according to the present invention;

FIG. 2 is a perspective view of a receiving unit according to the present invention for sample container receptacles;

FIG. 2*a* is a bottom view of the receiving unit of FIG. 2;

FIG. 2*b* is a lateral view of the receiving unit of FIG. 2;

FIG. 3*a* is a perspective view of a sample container receptacle;

FIG. 3*b* is a top view of the sample container receptacle of FIG. 3*a;*

FIG. 4*a* is a perspective view of another sample container receptacle;

FIG. 4*b* is a top view of the sample container receptacle of FIG. 4*a;*

FIG. 5 is a perspective view of a receiving unit according to the invention for sample container receptacles;

FIG. 5*a* is a bottom view of the receiving unit of FIG. 5;

FIG. 5*b* is a lateral view of the receiving unit of FIG. 5;

Figure 1:
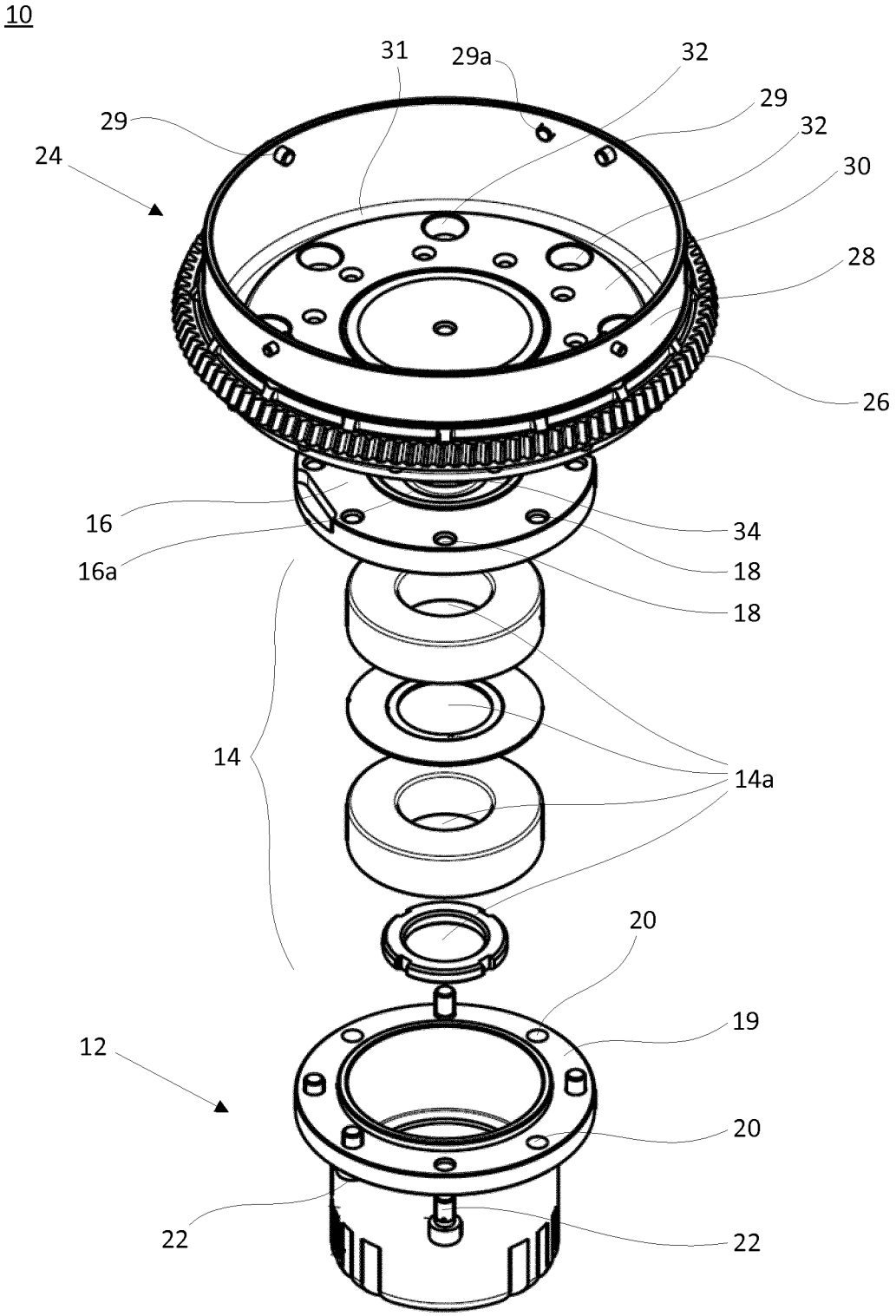

FIG. 1 is an exploded view of a rotational unit 10 according to the invention for a rotor of a centrifuge. The rotational unit 10 has a cup-shaped housing 12 in which a bearing 14 is concentrically mounted. On its open side, the housing 12 has a flange 19 which extends around its entire periphery and which has eight uniformly spaced bores 20. These bores 20 are matched to bores 18 in a cover disk 16 which is screw-connected to the housing by means of cylinder screws 22 and thus closes the open side of the housing 12.

The bearing 14 has a concentric opening 14*a*, and the cover disk 16 has a concentric opening 16*a*. A bearing shaft 34 of a rotational head 24 passes through opening 14*a* via opening 16*a*, thus mounting the rotational head 24 in the bearing 14 for concentric rotation therein.

The rotational head 24 has a bottom 30 and a wall 28 which is circumferentially arranged on the bottom 30. The bottom 30 and the wall 28 form a closed safety vessel. A circumferential safety channel 31 is provided in the bottom 30, directly adjacent to the wall 28, which will serve to collect any sample material leaking from the centrifuge in the case of a defect during operation.

Adjacent to its free end, the wall 28 has four positioning pins 29 uniformly spaced from each other along its periphery as well as a single positioning pin 29*a*. Provided in the bottom 30 are eight holes 32 that are uniformly spaced from each other and located adjacent to the wall 28. The function of said positioning pins 29, 29*a* and said holes 32 will be explained below with reference to the following figures. Toothing 26 extends circumferentially along the entire periphery of the wall 28 and is connected to the wall for conjoint rotation therewith. Said toothing 26 meshes with a gear, not shown for the sake of clarity, of a conventional gear drive of another rotation mechanism of the centrifuge. The use of gear drives as a further rotation mechanism is well known and has already been described in the prior art, for which reason no further explanations are required here.

Figure 2:
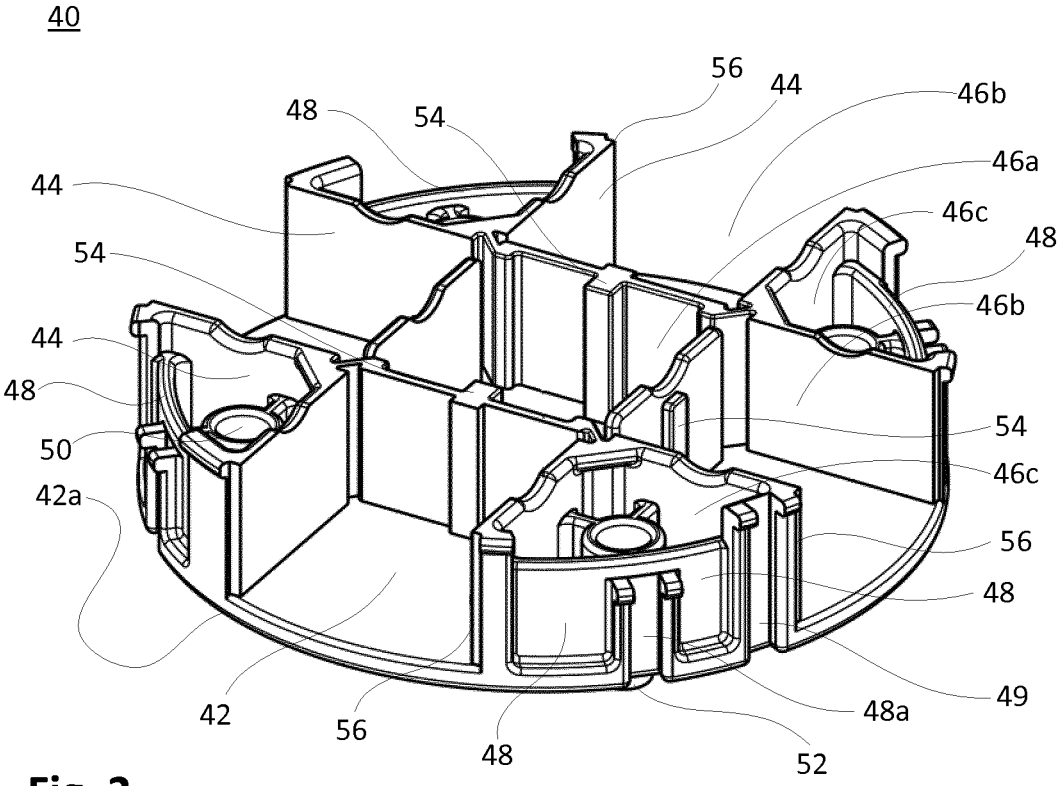
Figure 2A:
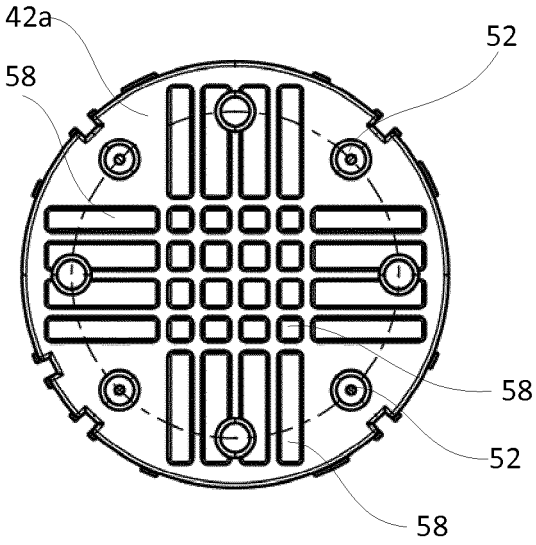
Figure 2B:
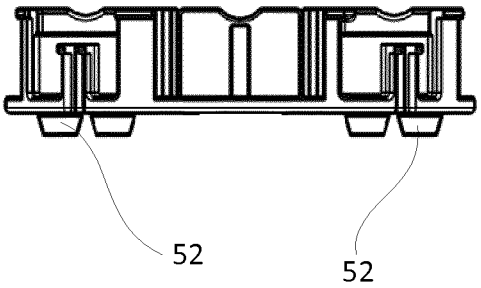

FIG. 2 is a perspective view of a receiving unit 40 according to the invention for sample container receptacles. FIG. 2*a* is a bottom view of the receiving unit 40 of FIG. 2. FIG. 2*b* is a lateral view of the receiving unit 40 of FIG. 2. The receiving unit 40 has an essentially circular bottom 42 with an underside 42*a* and two pairs of partition walls 44 each arranged in parallel to each other and having ends 56. The circumference of the bottom 42 has been chosen such that the receiving unit 40 can be inserted with only mirror clearance in the rotational head 24 with the safety vessel. Any sample material leaking from the centrifuge during operation in the event of a defect can thus flow downward through a gap between the circumference of the bottom 42 and the inner circumference of the rotational head 24 of FIG. 1 and the wall 28 and into the safety channel 31 where it is then collected.

The two pairs of partition walls 44 are arranged perpendicular to each other in the shape of a double cross. After the receiving unit 40 has been introduced into the rotational head 24, this will thus result in a total of five recesses 46*a*, 46*b* for receiving sample container receptacles 60, 70 as described with reference to the following FIGS. 3*a*, 3*b*, 4*a* and 4*b*. The recesses 46*a*, 46*b* are limited laterally by parts of the partition walls 44 of the same length and partially by the wall 28 of the rotational head 24, which wall 28 has been omitted from FIG. 2 for the sake of clarity. The recess 46*a* located at the center of the double cross is limited on four sides by parts of the partition walls 44 and has a square base area. On each side of the recess 46*a* there is an adjacent recess 46*b* which is limited on three sides each by portions of the partition walls 44. Another four recesses 46*c* which are limited by portions of the partition walls 44 on two sides each, are located between two recesses 46*b* each, as viewed along the periphery of the bottom 30. In each recess 46*a* and 46*b* a projection 54 is formed on at least part of a partition wall 44, which projection serves to guide the sample container receptacles 60, 70 during their insertion.

A sample container receptacle 60, 70 whose outer circumference is adapted to the base area of the recess 46*a* is also fixed in position without clearance in each direction parallel to the bottom 30 of the receiving unit 40, since the ends 56 of the partition walls 44 form stops together will the wall 28 of the rotational head 24, which stops prevent the sample container receptacles 60, 70 from being moved beyond the end 56. Consequently, the receiving unit 40 is suited to accommodate up to five sample container receptacles 60, 70 at a time for centrifugation.

For enhanced stability of the partition walls 44, each recess 46*c* is provided with a rounded outer wall 48 which is adapted to the area of the wall 28 of the rotational head 24 associated with the receiving unit 40 when inserted, which wall 48 connects the two associated ends 56 of the partition walls 44. A stabilizing rail 48*a* is mounted at the center of each of the four outer walls 48, which rail 48*a* rests against the wall 28 of the rotational head 24 in the inserted state of the receiving unit 40. During insertion of the receiving unit 40 into the rotational head 24, the four stabilizing rails 48*a* additionally cooperate with the positioning pins 29 in the wall 28 as illustrated in FIG. 1 and thus serve to guide the receiving unit 40. Moreover, the positioning grooves 48*a* and their associated positioning pins 29 act together to support the receiving unit 40 in the rotational head 24 for conjoint rotation. Furthermore, a single guide rail 49 is provided on one of the four outer walls 48 which rail 49 has the positioning pin 29*a* associated with it. The interaction of the guide rail 49 with the positioning pin 29*a* ensures the correct alignment of the receiving unit 40.

The recesses 46*c* accommodate essentially cylindrical taper pins 50 which extend through the bottom 42 of the receiving unit 40 and are firmly connected to said bottom 42. On the underside 42*a* of said bottom 42, the free end of each taper pin 50 forms a frusto-conical foot 52 which is dimensioned so as to match its associated hole 32 in the bottom 30 of the rotational head 24. As a result, once the receiving unit 40 has been inserted, the feet 52 and the holes 32 will yield a reliable wedging/clamping effect.

On the side opposite the underside 42*a* of the bottom 42, the taper pins 50 are oriented perpendicular to said bottom 42 and extend vertically almost up to the height of the free ends of the outer walls 48.

The underside 42*a* furthermore has a cross-shaped arrangement of knobs 58 which act to space the underside 42*a* from the bottom 30 so as to minimize heat transfer. The cross-shaped configuration was chosen because it is a good compromise between stability and weight reduction.

Figure 3A:
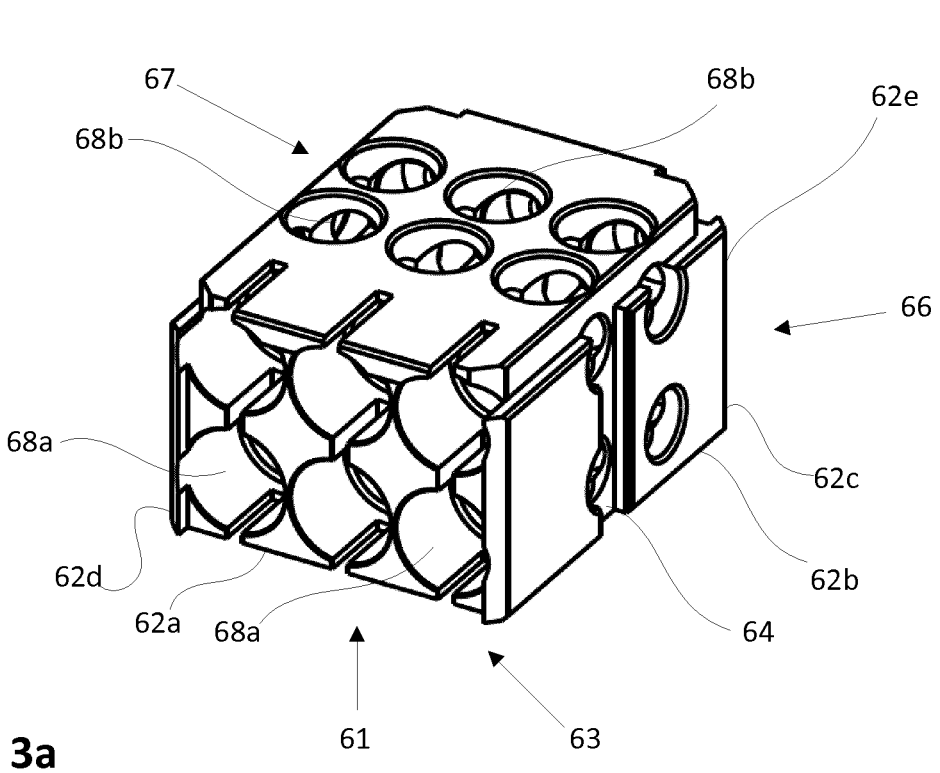
Figure 3B:
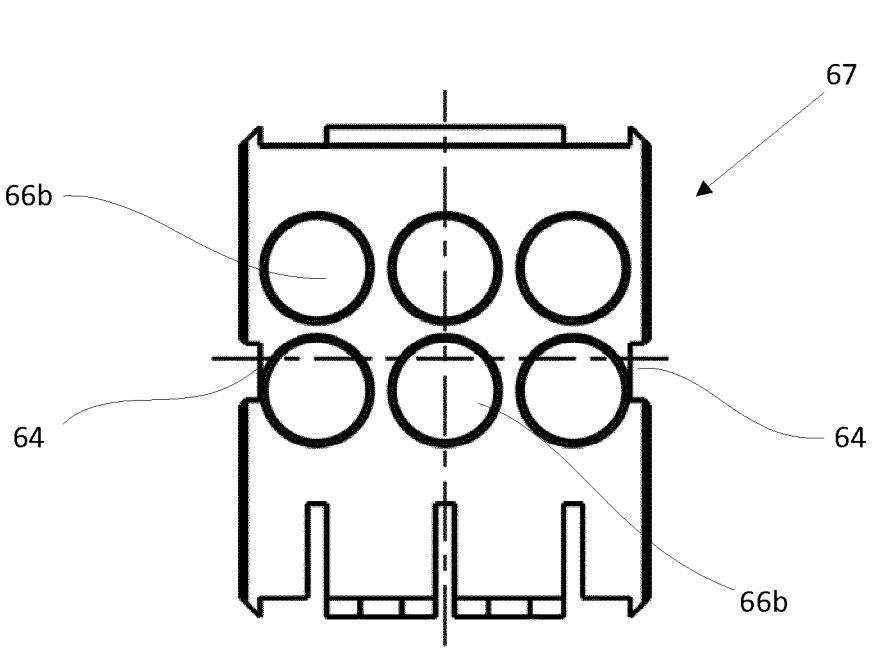

FIG. 3*a* is a perspective view of an embodiment of a sample container receptacle 60. FIG. 3*b* is a top view of the sample container receptacle 60.

The sample container receptacle 60 has a bottom wall 61 matching the recesses 46*a* and 46*b* illustrated in FIG. 2 and having an edge 62*a*, another edge 62*c* which is parallel to the edge 62*a*, an edge 62*b* and another edge 62*d* which is parallel to the edge 62*b*, with all these edges being of the same length. There are four edges 62*e* which extend perpendicular to the bottom wall 61. An insertion wall 63 delimited by edge 62*a* and two edges 62*e* has six bearing recesses 68*a* provided therein, in which up to six centrifuge tubes can be stored horizontally. Parallel to the bottom wall 61, a top wall 67 of the sample container receptacle 60 is arranged. Six bearing recesses 68*b* are provided in the top wall 67 in which up to six centrifuge tubes (not shown for the sake of clarity) can be accommodated vertically. A positioning groove 64 is provided in a sidewall 66 which is delimited by the edge 62*b* and two edges 62*e*, which groove 64 is associated with a projection 54 as shown in FIG. 2 and serves to correctly position said projection 54 in the recess 46*a*, 46*b* as the sample container receptacle 60 is inserted.

Figure 4A:
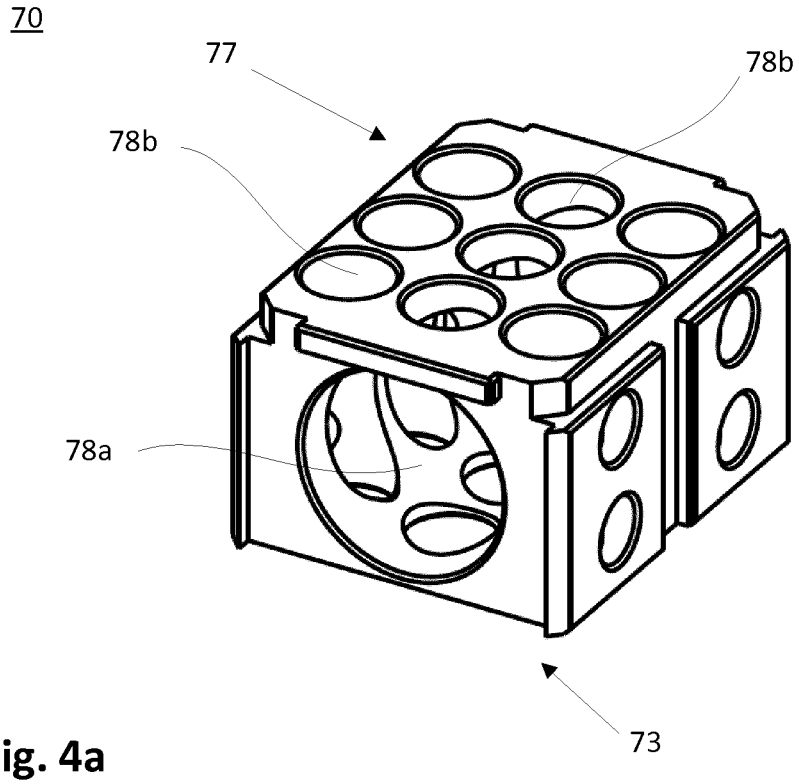
Figure 4B:
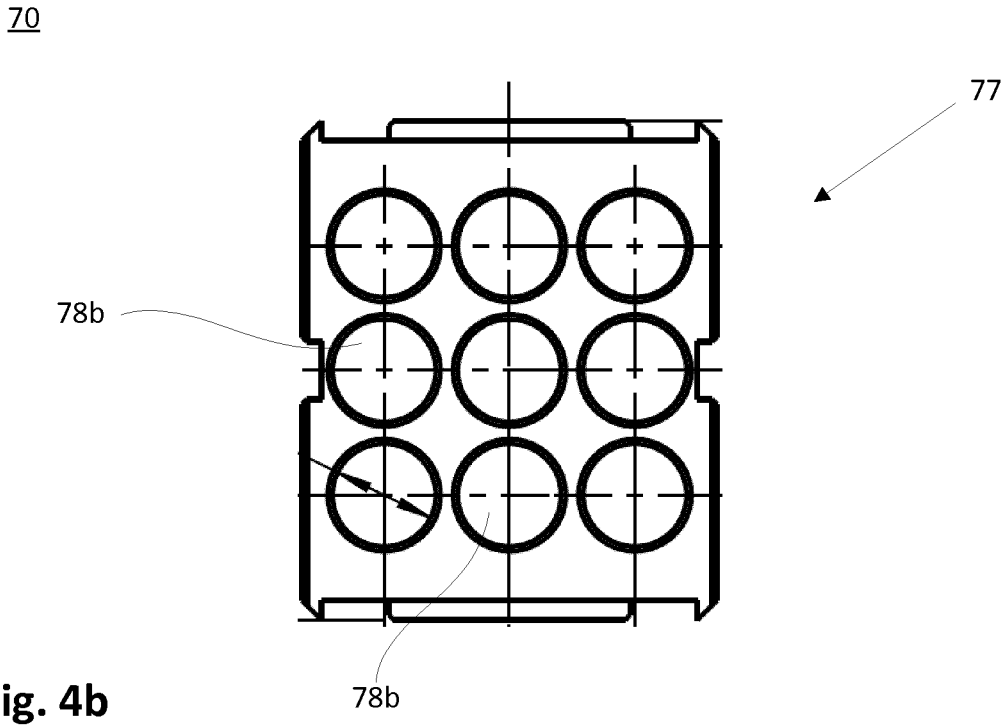

FIG. 4*a* is a view of an alternative embodiment of a sample container receptacle 70. FIG. 4*b* is a top view of the sample container receptacle 70.

The sample container receptacle 70 differs from the sample container receptacle 60 merely in that it has nine bearing recesses 78*b* provided in its top wall 77 instead of the six bearing recesses 68*b* in the top wall 67, and in that a single bearing recess 78*a* is provided in its insertion side 73 instead of the six bearing recesses 68*a* in the front side 63.

The two embodiments of the sample container receptacles 60, 70 only show two options of how the correspondingly designed sample container receptacle can be used to accommodate cylindrical tubes of different sizes and number in a rotational unit 10 according to the invention. Sample container receptacles suitable for other requirements can be manufactured easily.

Figure 5:
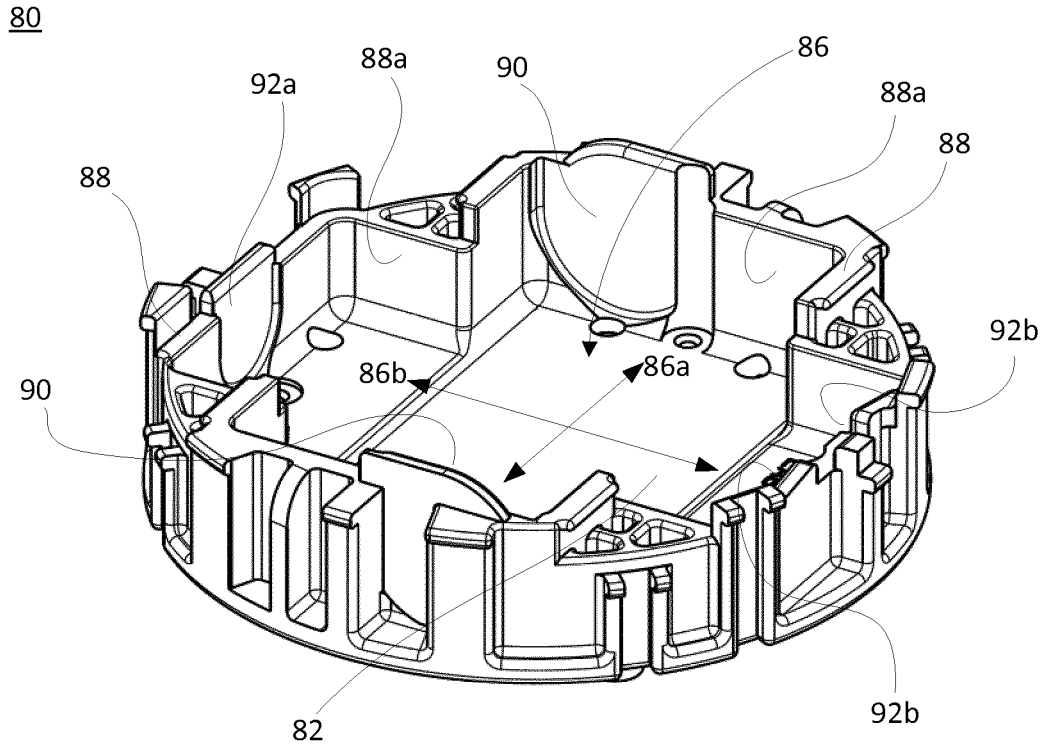
Figure 5A:
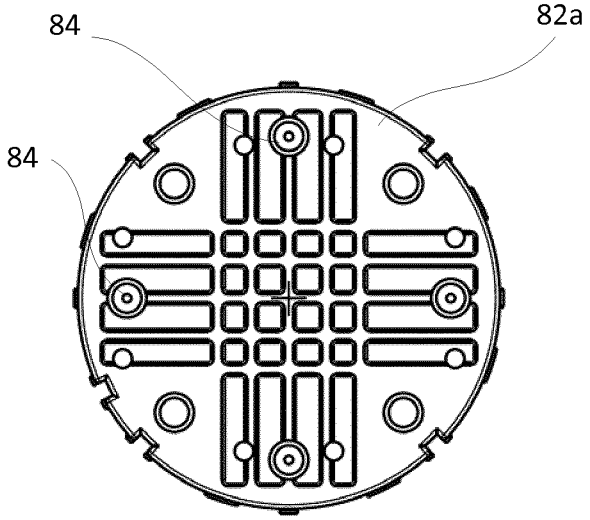
Figure 5B:
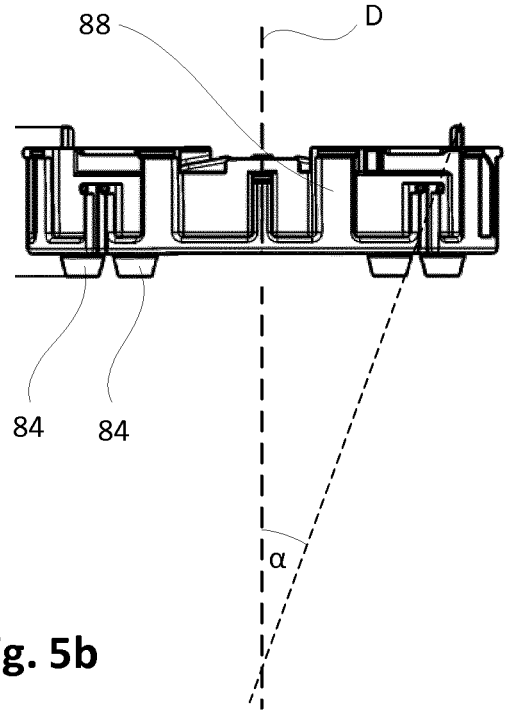

FIG. 5 is a view of an alternative embodiment of a receiving unit 80 according to the invention. FIG. 5*a* is a bottom view of the receiving unit 80 of FIG. 5. FIG. 5*b* is a lateral view of the receiving unit 80 of FIG. 5.

The receiving unit 80 differs from the receiving unit 40 in that it is adapted to receive a single sample container receptacle 100 (see FIG. 6) or 110 (see FIG. 7) and therefore has no partition walls similar to the partition walls 44 of receiving unit 40. Secondly, in contrast to receiving unit 40, receiving unit 80 has a safety wall 88 which is arranged circumferentially on the outer contour of a bottom 82. As regards the insertion of the receiving unit 80 into the rotational head 24 as well as the resulting wedging effect between the feet 84 provided on the underside 82*a* of the receiving unit 80 and the holes 32 provided in the rotational head 24, receiving unit 80 does not differ from what was described with reference to FIG. 2, 2*a*, 2*b*.

An inner contour 88*a* of the safety wall 88 delimits a cross-shaped receiving space 86. Two rectangular legs 86*a* and 86*b* of the receiving space 86 are arranged so as to be perpendicular to each other, with the surface areas of the first leg 86*a* and of the second leg 86*b* being identical and corresponding to the surface areas of the sample containers 100, 110 shown in FIG. 6 and FIG. 7.

The first leg 86*a* is adapted to receive the sample container receptacle 100. For this purpose, a recess 90 has been provided in the safety wall 88 in either end of leg 86*a*, both said recesses 90 being arranged diametrically to one another relative to the leg 86*a*. The recesses 90 serve to ensure reliable wedging of the sample container receptacle 100 with inserted sample container in the receiving unit 80, as will be explained in more detail with reference to FIG. 6.

The second leg 86*b* serves to receive the sample container receptacle 110. For this purpose, one end of the leg 86*b* has a recess 92*a* in the safety wall 88 and the second end of the leg 86*b* has two recesses 92*b* in the safety wall 88. These recesses 92*a, b* serve to ensure secure wedging of the sample container receptacle 110 in the receiving unit 80, as will be explained in more detail with reference to FIG. 7.

For enhanced protection of the rotational unit from contamination by sample material in the event of damage to a receptacle, it is also conceivable to insulate the safety wall 88 from the outside and to provide a lid for the receiving unit 80 on the safety wall 88. This will limit potential leakage of sample material from the sample container receptacles 100, 110 to the receiving unit 80.

Figure 6:
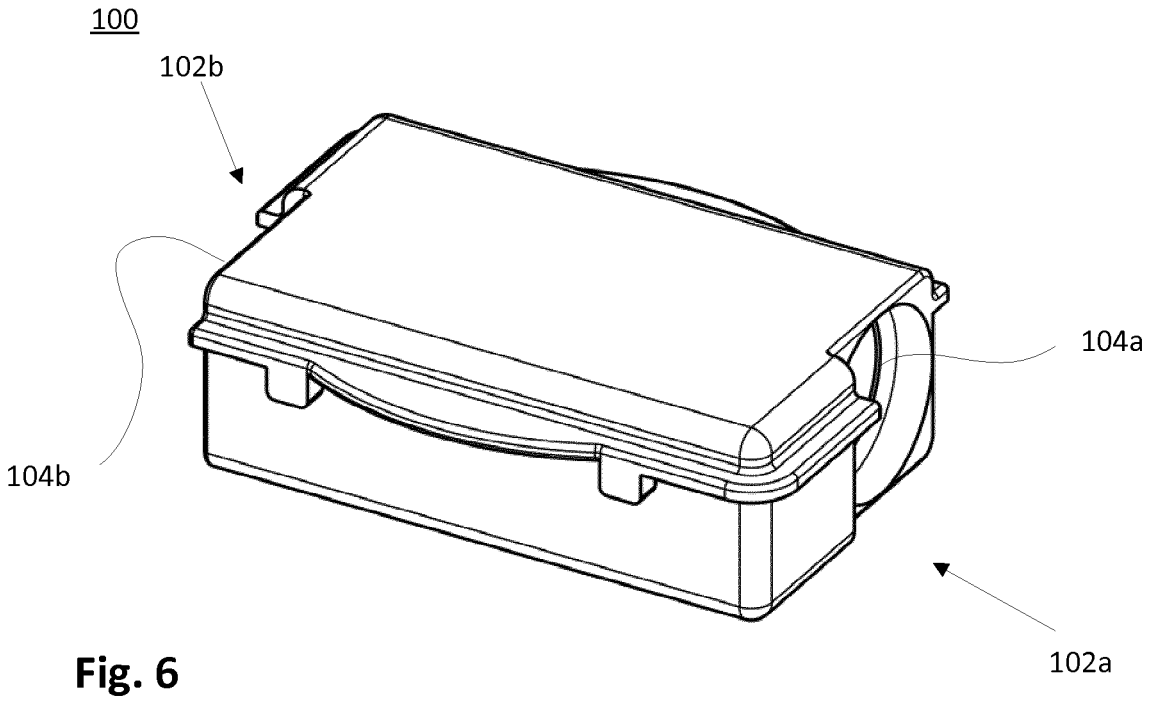
FIG. 6 is a perspective view of a sample container receptacle according to the invention.

FIG. 6 is a view of a first sample container receptacle 100 according to the invention, which—as described with reference to FIGS. 5, 5*a* and 5*b*—is adapted to be received in the first leg 86*a* of the receiving unit 80.

The sample container receptacle 100 has an opening 104*a, b* each in two front sides 102*a, b* which can receive a centrifuge tube each (not shown for the sake of clarity) for vertical storage therein. An end of the centrifuge tube (lid side) which protrudes from the respective opening 104*a, b* on either front side 102*a, b* engages an associated recess 90 provided in the safety wall 88. This results in a wedging action which firmly clamps the sample container receptacle 100 in the receiving unit 80.

Figure 7:
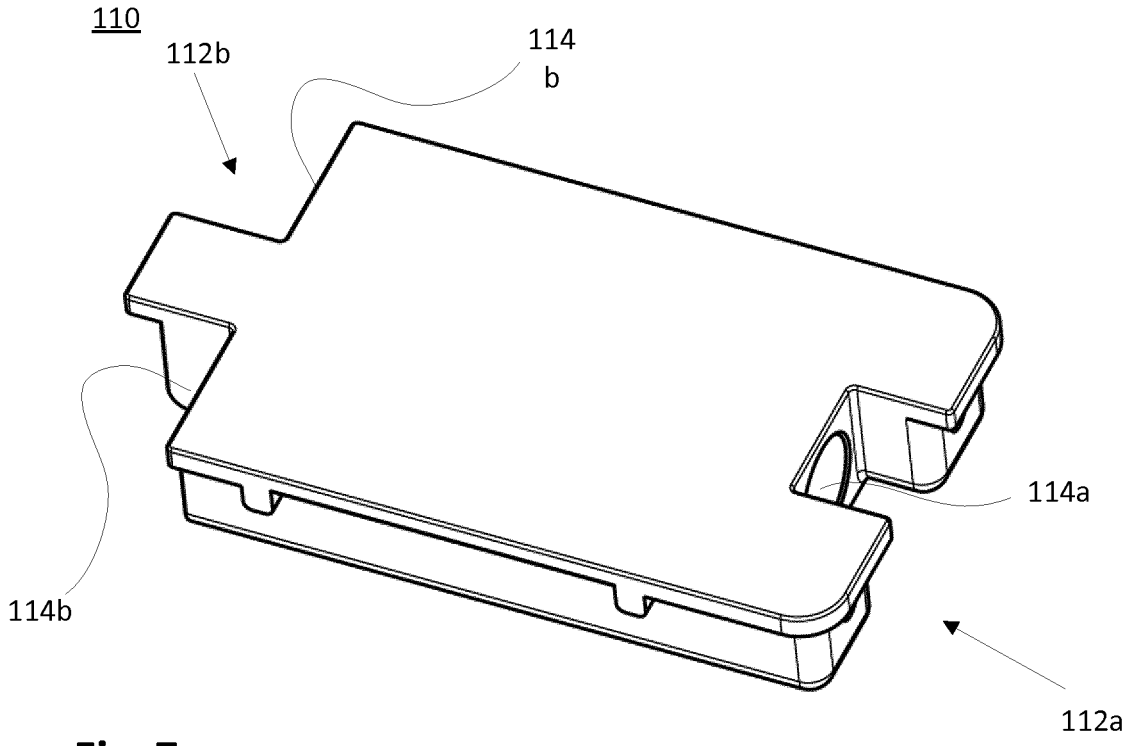
FIG. 7 is a perspective view of another sample container receptacle according to the invention.

FIG. 7 is a view of a second sample container receptacle 110 according to the invention which is adapted to be received in the second leg 86*b* of the receiving unit 80.

In FIG. 7, on the front side 112*a* facing the observer, the sample container receptacle 110 has an opening 114*a* and on the front side 112*b* facing away from the observer, it has two openings 114*b*. These openings 114*a, b* can be used to receive centrifuge tubes (not shown here for the sake of clarity) so as to vertically accommodate them therein. Similar to the solution shown in FIG. 6, the ends of a centrifuge tube which protrude from the respective opening 114*a, b* on either front side 112*a, b* engage an associated recess 92*a, b* made in the safety wall 88. This produces a reliable wedging action between the sample container receptacle 110 and the receiving unit 80.

Figure 8:
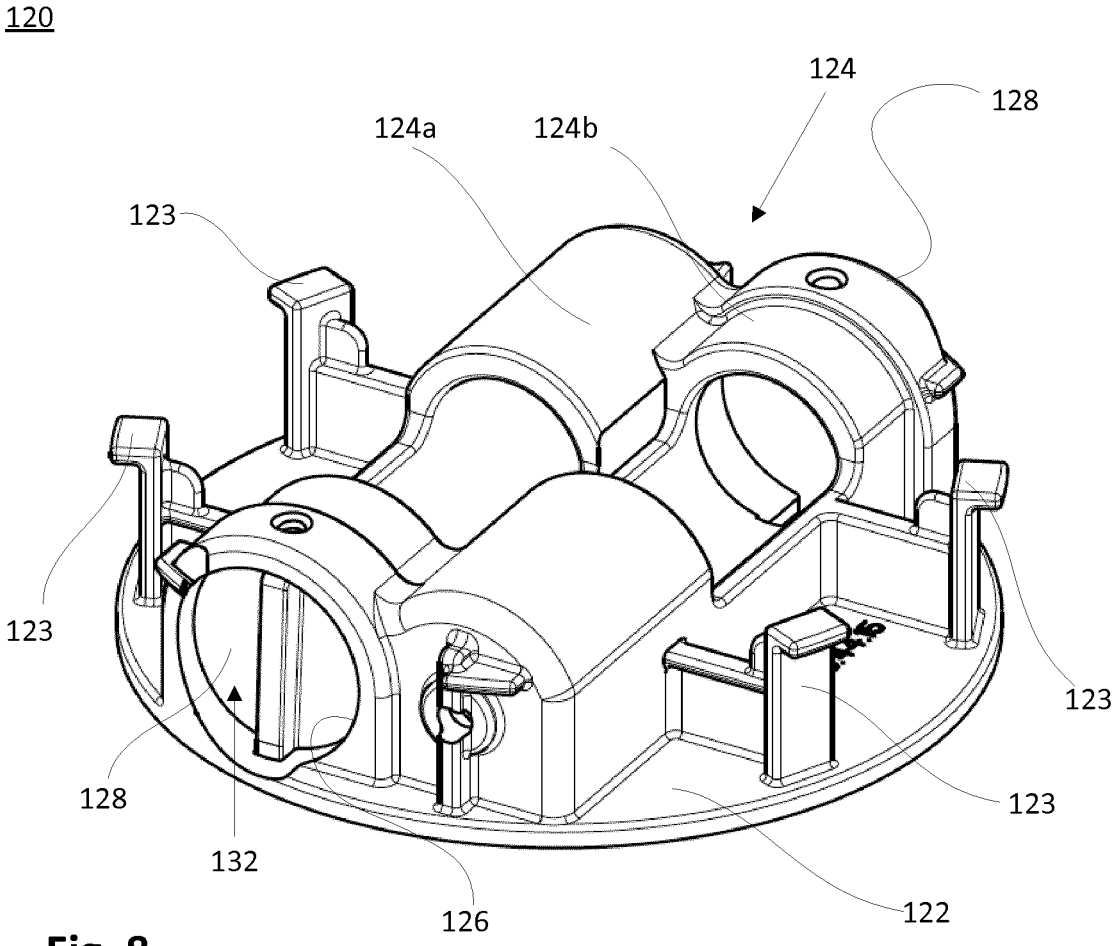
FIG. 8 is a perspective view of a receiving unit according to the invention formed integrally with a sample container receptacle.

FIG. 8 is a view of a receiving unit 120 which is integrally formed with a sample container receptacle 124 and adapted to horizontally receive two sample containers.

Similar to the receiving units 40 and 80 described with reference to FIGS. 2 and 5, the receiving unit 120 has an essentially circular bottom 122 whose circumference matches the inner circumference of the rotational head 24 of FIG. 1 and the wall 28 so as to allow the receiving unit 120 to be fitted without any clearance into the rotational head 24 with the safety vessel. On the bottom 122 a sample container receptacle 124 is horizontally disposed and adapted to receive two sample containers (vials, not shown here) in a horizontal position. The sample container receptacle 124 comprises two parallel receiving tubes 124*a*, 124*b* integrally formed from the same material. At their opposite ends, with respect to their longitudinal extension, the receiving tubes 124*a*, 124*b* have a receiving opening 126 each, into which the vials can be introduced.

Four wall members 123 are arranged vertically on the bottom 122 and distributed along its periphery, which members 123 are adapted to center the receiving unit 120 as it is introduced into the rotational head 24 and to stabilize it once it has been fully inserted. These members therefore function in a way that can be compared to the ends 56 of the partition walls 44 of the receiving unit 40.

Figure 8A:
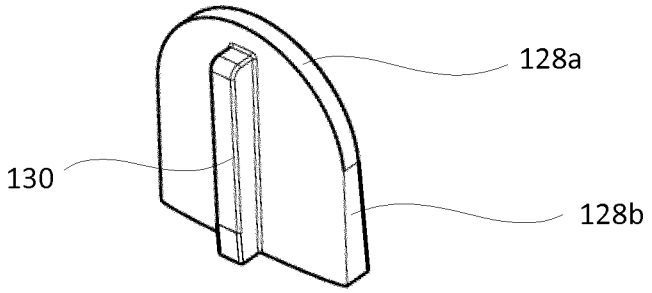
FIG. 8*a* is a detailed view of the wedge element illustrated in FIG. 8.

A closing plate 128 each is provided to seal each receiving opening 126, as can be seen in FIG. 8*a*. The surface area of this closing plate 128 is defined by a semicircular portion 128*a* followed by a rectangular portion 128*b*. This closing plate 128 can be introduced in a direction of insertion 132 by means of a recess in the bottom 122 which cannot be seen from this perspective, which recess is followed by a groove (not visible in this view) which each extends in the region adjacent to the receiving opening 126 within the receiving tubes 124*a*, 124*b*. This groove serves to guide and secure the closing plate 128. The thickness of the closing plate 128 as well as the width of the groove are essentially adapted to each other, with the thickness of the rectangular portion 128*b* slightly increasing against the direction of insertion 132. This results in a wedging effect once the closing plate has been fully inserted in the groove. This wedging effect prevents the closing plate 128 from accidentally falling out of the recess in the bottom 122. Furthermore, a wedging effect is produced between the fully inserted closing plate 128 and the introduced vial.

The closing plate 128 has a web 130 mounted thereon which serves as a handle for the user.

LIST OF REFERENCE SIGNS

10 rotational unit
12 housing
14 bearing
14*a* concentric opening
16 cover disk
16*a* concentric opening
18 bores
19 flange
20 bores
22 cylinder screws
24 rotational head
26 toothing
28 wall
29 positioning pin
29*a* positioning pin
30 bottom
31 safety channel
32 holes
34 bearing shaft
40 receiving unit
42 bottom
42*a* underside
44 partition walls
46*a, b, c* recesses
48 exterior walls
48*a* stabilizing rails
49 guide rail
50 taper pins
52 feet
54 projection
56 ends
58 knob assembly
60 sample container receptacle
61 bottom wall
62*a, b, c, d, e* edges
63 insertion wall
64 positioning grooves
66 sidewall
67 top wall
68*a, b* bearing recesses
70 sample container receptacle
73 insertion wall
77 top wall
78*a, b* bearing recesses
80 receiving unit
82 bottom
82*a* underside
84 feet
86 receiving space
86*a* first leg
86*b* second leg
88 safety wall
88*a* interior profile
90 recesses
92*a, b* recesses
100 dual sample container receptacle
102*a, b* front sides
104*a, b* openings
110 triple sample container receptacle
112*a, b* front sides
114*a, b* openings
120 receiving unit
122 bottom
123 wall members
124 sample container receptacle
124*a, b* receiving tubes
126 receiving apertures
128 closing plate
128*a* semicircular area
128*b* rectangular area
130 web
132 direction of insertion
α angle
D axis of rotation

The invention claimed is:

1. Rotational unit (10) for a rotor of a dual centrifuge, comprising:

a bearing (14);

a rotational head (24) connected to said bearing (14);

a housing;

said bearing mounted in said housing such that it can rotate about an axis of rotation and can be driven relative to said rotor by an additional rotational mechanism of said centrifuge, said rotational head (24) being detachably connected to a receiving unit (40, 80) for conjoint rotation;

said receiving unit comprises a sample container receptacle (60, 70, 100, 110) for at least one sample container; and, said receiving unit (40, 80) and said rotational head (24) are connected by a frictional connection in which some portions of said receiving unit (40, 80) and said rotational head (24) engage in a wedge-like manner, and said frictional connection increases with a movement of said receiving unit (40, 80) along said axis of rotation of said rotational unit (10) toward said rotational head (24).

2. Rotational unit according to claim 1, further comprising:

said rotational unit is obliquely mounted in said rotor such that increasing rotation will cause said receiving unit (40, 80) to be urged into said frictional connection.

3. Rotational unit according to claim 1, further comprising:

said frictional connection is effective between an underside (42*a*, 82*a*) of said receiving unit (40, 80) and a bottom (30) of said rotational head (24).

4. Rotational unit according to claim 1, further comprising:

said receiving unit (40, 80) includes frusto-conical feet and said rotational head (24) has matching recesses (32); and, said frusto-conical feet (52, 84) of said receiving unit (40, 80) and said recesses (32) of said rotational head (24) engage.

5. Rotational unit according to claim 4, further comprising:

the longitudinal axes of said frusto-conical feet (52, 84) are aligned in parallel to said axis of rotation of said rotational head (24);

said frusto-conical feet (52, 84) are of a rotationally symmetric design, and that a line resulting from a longitudinal section through the surface of said conical portion of said frusto-conical feet defines an angle ($\alpha$) of 15° with the axis of rotation (D).

6. Rotational unit according to claim 4, further comprising:

either of said feet (52, 84) and said receiving unit (40, 80) or said feet (52, 84) and said rotational head (24) are integrally formed from the same material.

7. Rotational unit according to claim 4, further comprising:

the number and size of said feet (52, 84) are adapted to the shearing strength of the material of said feet (52, 84) with respect to the forces resulting from the alternating rotational stress in operation of said centrifuge.

8. Rotational unit according claim 4, further comprising:

the ratio of the diameter of the base area of the truncated cone of a foot (52, 84) relative to the height of the truncated cone is 10:6.

9. Rotational unit according to claim 7, further comprising:

the material used for said receiving unit (40, 80) is polyamide plastic; and, the material used for the rotational head (24) and the sample container receptacles is aluminum alloy EN AW-Al Zn5Mg3Cu-T6.

10. Rotational unit according to claim 4, further comprising:

an even number of feet (52, 84), at least four feet, are arranged in a rotationally symmetric manner and uniformly spaced from each other.

11. Rotational unit according to claim 4, further comprising:

said feet (52, 84) are located on the edge of said receiving unit (40, 80).

12. Rotational unit according to claim 1, further comprising:

said rotational head (24) has a safety vessel (28) which is open toward the top, said safety vessel (28), when mounted, will completely laterally surround said receiving unit (40, 80) with the sample container receptacle (60, 70, 100, 110) therein.

13. Rotational unit according to claim 1, further comprising:

a peripheral safety channel (31) is provided in said bottom (30) of said rotational head (24).

14. Rotational unit according to claim 1, further comprising:

a safety vessel (28):

a lid for said safety vessel (28); and, said lid is connected to said safety vessel by means of a quick-release fastener or a screw connection.

15. Rotational unit according to claim 1, further comprising:

a peripheral safety channel (31) is provided in the said bottom (30) of said rotational head (24);

said receiving unit has feet (52); and, said bottom (30) of said rotational head (24) has recesses for connection to said feet (52) of said receiving unit (40, 80).

16. Rotational unit according to claim 13, further comprising:

a safety vessel (28); and, said safety vessel (28) is connected to said rotational head (24) by a rivet means.

17. Rotational unit according to claim 1 further comprising:

said rotational head (24) and said safety vessel (28) are integrally formed as one component of the same material.

18. Rotational unit according to claim 1, further comprising:

said receiving unit (40, 80) includes a lateral surface;

a safety vessel, said safety vessel includes a perimeter wall; and, said frictional connection acts on said lateral surface of said receiving unit (40, 80) and on said perimeter wall of said safety vessel (28).

19. Rotational unit according to claim 13, further comprising:

said sample container receptacle (60, 70, 100, 110) is inserted into said receiving unit (40, 80) and is detachably mounted therein.

20. Rotational unit according to claim 19, further comprising:

a set of receiving units (40, 80) is provided for different designs of sample container receptacles (60, 70, 100, 110).

* * * * *